United States Patent [19]

Sammens

[11] Patent Number: 4,525,985

[45] Date of Patent: Jul. 2, 1985

[54] APPARATUS FOR AUTOMATICALLY PACKAGING ARTICLES

[75] Inventor: Bo Sammens, Sättra, S-387 00 Borgholm, Sweden

[73] Assignee: Bo Sammens, Borgholm, Sweden

[21] Appl. No.: 479,960

[22] Filed: Mar. 29, 1983

[51] Int. Cl.[3] ..... B65B 57/14; B65B 5/08

[52] U.S. Cl. ..... 53/497; 53/499; 53/539; 53/247; 198/434

[58] Field of Search ..... 53/247, 448, 473, 499, 53/539, 543; 198/419, 426, 429, 434

[56] References Cited

U.S. PATENT DOCUMENTS 3,169,354 2/1965 Bliss et al. ..... 53/247
3,316,688 5/1967 Niederer et al. ..... 53/543
3,760,553 9/1973 Schmidt, Sr. et al. ..... 53/448
3,854,569 12/1974 Steinhart et al. ..... 198/434

*Primary Examiner*—Lowell A. Larson
*Assistant Examiner*—Jorji M. Griffin
*Attorney, Agent, or Firm*—Toren, McGeady, Stanger

[57] ABSTRACT

Discrete articles moving on a conveyor belt are first laterally aligned in rows extending transversely to direction of movement of the conveyor belt and then engaged in compartments arranged in rows extending across the conveyor belt. The compartments containing the articles are then shifted to overlie packages located beneath the compartments and the aligned rows of articles from within the compartments are permitted to drop into the packages.

13 Claims, 4 Drawing Figures

II

APPARATUS FOR AUTOMATICALLY PACKAGING ARTICLES

The present invention relates generally to automated packaging apparatus and more specifically to a procedure and mechanism wherein discrete articles are first automatically aligned and then inserted into packages. The invention is particularly useful in connection with confectionary products of the type known as coconut or chocolate balls which are fed forwardly from a casting or molding station by a conveyor belt.

Presently, in the prior art, a great deal of packaging of products is performed for the most part by manual insertion of the products into the finished packages. This is particularly true in the confectionary industry and such manual product handling has, accordingly, been the focus of efforts to improve automation, since manual handling is labor-intensive and since most of the production costs consist of payroll expenses.

For example, picking operations involving confectionary articles known as coconut or chocolate balls from a belt conveyor and insertion of the balls in packages usually requires four operators on either side of a conveyor belt. Method and time studies have produced continuous development of improved working operations, better work station layouts, and handling aids, but nevertheless manual handling of such products still constitutes a substantial financial burden. Consequently, efforts have been devoted toward increasing the degree of automation of such product handling in the confectionary industry.

The present invention is directed toward the provision of procedures and devices which will enable the products to be automatically aligned, both longitudinally and laterally, on a conveyor belt and then grouped and inserted into trays or boxes with varying speeds, with the speeds being dependent upon the width of the belt, the number of products arranged in a lateral row, and the belt speed. The invention is directed toward enabling the products to be aligned and grouped in modules which are shaped in accordance with the design and arrangement of trays or packages which are to be filled with the articles.

Furthermore, the invention seeks to provide a mechanism for aligning and grouping articles which may be formed as one unit and which may operate to arrange the articles in modules systematically and without undue disturbance. Additionally, the invention seeks to provide a device whereby the products may then be moved and placed in trays or boxes which stand ready for filling.

SUMMARY OF THE INVENTION

Briefly, the present invention may be described as a process and apparatus for automatically packaging discrete articles wherein the articles are first aligned on a conveyor belt in rows extending laterally across the direction of movement of the conveyor belt. The alignment means include laterally extending bars which are raised and lowered to engage the moving articles and to thereby align them in rows.

The articles are subsequently engaged within grouping means defining a plurality of individual compartments within which the individual articles are held. The compartments are also arranged in rows extending laterally across the direction of travel of the conveyor means and after each of the individual articles has been moved into the rows of compartments, the grouping means is shifted laterally from over the conveyor belt to a location above packages to be filled. The packages have planar cover means overlying the empty compartments thereof and after the grouping means with the individual articles contained in the various compartments have been moved over the packages, the planar cover means is laterally moved to expose the packages thereby allowing the aligned articles to drop into the correspondingly aligned compartments of the packaging means.

The compartments of the grouping means are formed by elements which define the forwardmost and rearmost sides of the compartments. For each row of compartments, all of the elements defining the forwardmost side of a compartment are commonly mounted and they may be raised and lowered vertically relative to the conveyor means in unison. As the rows of articles moving on the conveyor means are brought beneath the grouping means, the elements defining the forwardmost sides of a row of compartments are moved down and after the articles have become engaged against the forwardmost sides of each of the compartments, the elements defining the rearmost sides are moved down behind the row of articles. This procedure is repeated for successive rows and in the grouping means the forwardmost and rearmost sides of adjacent rows of compartments may be commonly supported and moved vertically relative to the conveyor means in unison.

Thus, the mechanism of the invention may be seen to include aligner means whereby the articles are aligned in rows relative to the conveying means, and a grouping unit and inserter which operates to move groups of articles arranged in rows to overlie packages into which the articles are dropped or inserted. The device may be electronically controlled and the mechanical movements are carried out pneumatically by means of air cylinders. Electrically controlled valves together with photocells and switches constitute impulse control means enabling the system to function.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENT

Figure 2:
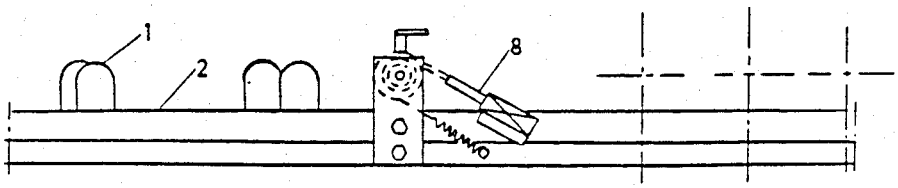
FIG. 2 is a side view of the aligner means shown in FIG. 1.
Figure 1:
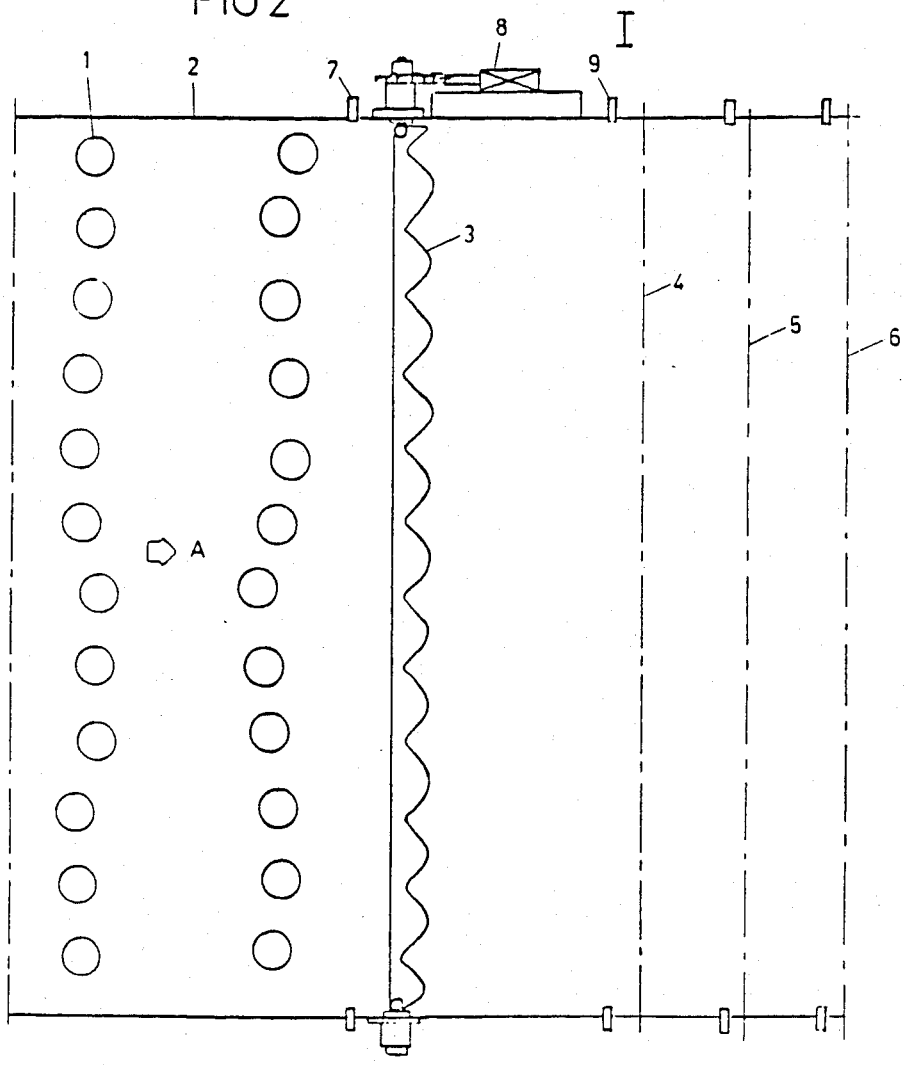
FIG. 1 is a top plan view of an aligner means in accordance with the present invention.

Referring now to the drawings, the apparatus of the present invention is shown as comprising two basic mechanisms which include aligner means I depicted in FIGS. 1 and 2 and a grouping unit II depicted in FIGS.

3 and 4. The articles to be sorted are first processed through the aligner means I shown in FIGS. 1 and 2 and then transported to the grouping unit II shown in FIG. 3 and 4 for insertion into packaging trays 10.

Referring now to FIGS. 1 and 2 and to the aligner means I shown therein, articles 1 which may be coconut balls or similar small spherical articles are fed in a feed direction A upon a conveyor belt 2 from a casting station. The aligner means I shown in FIGS. 1 and 2 comprises four consecutively arranged aligning arms 3, 4, 5, and 6, which extend laterally across the conveyor belt 2 transversely to the feed direction A. In FIGS. 1 and 2, the last three aligning arms 4, 5, and 6 are indicated by dash-dot lines.

The aligning arms 3–6 are normally held in the raised position above the belt 2. The distance between the underside of these arms and the belt is adapted to permit the articles 1 to pass therebetween. When a row of articles approaches the first aligning arm 3, a photocell 7 arranged adjacent to the conveyor belt 2 indicates the presence of this row of articles 1 and activates an air cylinder 8 which lowers the aligning arm 3 to the active position. In this position, the articles 1 which are moving in the direction A along the conveyor belt 2 will come into contact with the arm 3.

This contact will cause the articles 1 to be moved both longitudinally and laterally, a distance which is a maximum of about 20 mm, against the direction of the belt 2. In addition to an amplifier and receiver, the photocell 7 also embraces a time-delay relay which ensures that the arm 3 will be retained in the active alignment position for a sufficient length of time to move an entire row of articles 1 into alignment across the belt 2.

After the alignment of the row of articles 1 has been achieved, the air cylinder 8 moves the arm 3 upwardly into the inactive position whereupon the articles 1 may be transported to the next alignment station where there is located a photocell 9 and a second alignment arm 4 which is moved between the active and the inactive positions by an air cylinder (not shown) similar to the air cylinder 8. Further alignment of the row of articles is carried out at this station in the same way as that described for the station at which the first arm 3 is located.

The rows of articles 1 are aligned in as many stations comprising photocells, alignment arms, and air cylinders as are necessary to ensure that the desired alignment which is suitable for the subsequent procedures of the operation is obtained. For example, in the embodiment shown in FIGS. 1 and 2, each row of articles is aligned by passage through four aligning stations.

Figure 4:
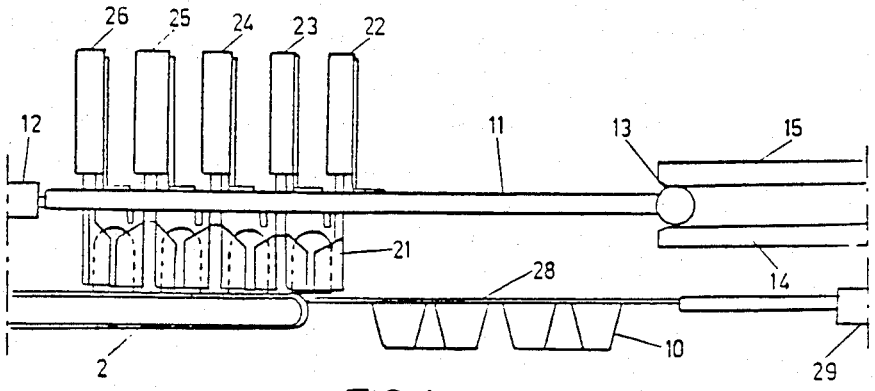
FIG. 4 is a side view of the grouping unit and inserter of FIG. 3.
Figure 3:
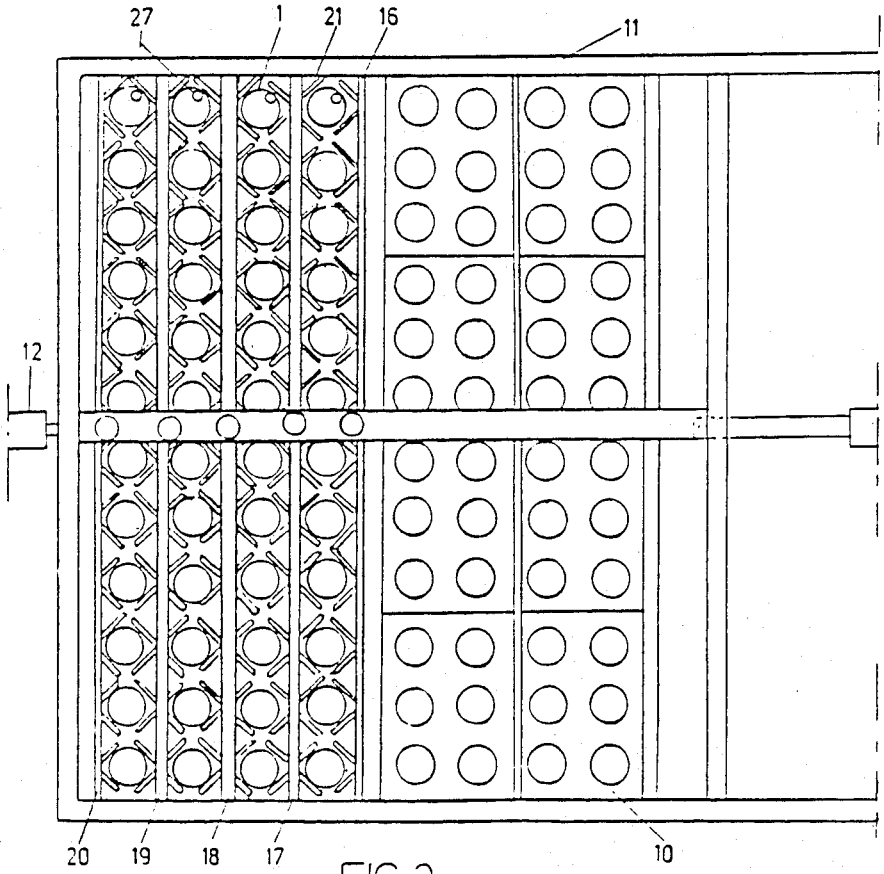
FIG. 3 is a top plan view of a grouping unit and inserter in accordance with the present invention located downstream from the aligner means of FIGS. 1 and 2.

The aligned rows of articles 1 are then transported to the grouping unit II shown in FIGS. 3 and 4 where they are grouped to form modules adapted to be readily inserted into packaging trays 10.

The grouping unit II comprises a trolley 11 which, as will be more fully described hereinafter, is adapted for reciprocal movement rightwardly and leftwardly as shown in FIG. 4. The trolley 11 includes a rectangular frame with the part thereof located closest to the conveyor belt 2, i.e., the left part thereof, being connected to an air cylinder 12. The part of the rectangular frame located farthest away from the conveyor belt 2 is provided with rollers 13 which run between a pair of horizontal guides 14 and 15. When the air cylinder 12 is actuated, the trolley 11 moves within a plane which is parallel to the plane of the conveyor belt 2 from a position above the belt 2, i.e., a leftward position, to a position above the packaging trays 10, i.e., a rightward position, which are arranged beyond the conveyor belt 2 as shown in FIG. 4.

The trolley 11 carries guide arms 16, 17, 18, 19, and 20 which are arranged to extend laterally across the conveyor belt transversely to the feed direction A. Each of the guide arms 16–20 is provided with guide devices 21 designed and configured in such a manner that the guide devices 21 on one of the guide arms, i.e., the guide arm 16, taken together with the guide devices 21 on an adjacent guide arm, i.e., the guide arm 17, will cooperate with each other to form a compartment within which an article 1 may be held.

That is, referring primarily to FIG. 3, it will be seen that arranged along the guide arm 16 are guide devices 21 which extend with a generally V-shaped configuration opening rearwardly of the unit, i.e., opposite to the feed direction A. Each of these devices 21 mounted on the guide arm 16 may be considered as elements which form the forwardmost sides of a compartment within which an article 1 may be held.

Arranged on the guide arm 17 are a similar plurality of devices 21 which extend toward the feed direction A; that is, they diverge or open in the same direction as the feed direction A. When the devices 21 located on the guide arm 16 and the devices 21 located on the guide arm 17 are placed in juxtaposed position opposite each other, as seen in FIG. 4, there is formed therebetween a compartment within which an article 1 may be held.

The guide arms 16–20 are individually moved from an inactive position to an active position above the belt 2 by operation of air cylinders 22, 23, 24, 25, and 26. These air cylinders are arranged vertically on the trolley 11 and each of the guide arms 16–20 is mounted on the piston rod associated with one of the air cylinders 22–26. In the inactive position, the guide arm is elevated or placed in a raised position above the conveyor belt 2 whereas in the active position the guide arm is lowered or is brought down to a position adjacent the conveyor belt 2. It should be noted that each of the guide arms 16–20 is individually movable from the active to the inactive position and it should further be noted that each of the guide arms, with the exception of the forwardmost guide arm 16 and the rearmost guide arm 20, is formed with elements 21 extending on both sides thereof so that the elements 21 located on the forwardmost side of each of the guide arms 17, 18, and 19 will form the rearmost sides of the compartments while the elements 21 located on the rearmost sides of each of the guide arms 17, 18, and 19 will form the forwardmost sides of the compartments for the articles 1.

The number of guide arms in the grouping unit II is adapted to the number of articles which may be held in the packaging trays 10. In the embodiment described herein, four rows of twelve articles 1 are to be grouped. Consequently, five guide arms are shown. As indicated previously, both of the outer guide arms 16 and 20 have guide devices 21 only on one side thereof facing inwardly toward the grouping unit while the intermediate guide arms 17, 18, and 19 have a two-sided arrangement of the guide devices 21.

When a first row of aligned articles 1 is moved into the grouping unit II, the forwardmost or first guide arm 16 located farthest into the unit is moved downwardly to its active position by operation of the air cylinder 22. The aforementioned first row of articles 1 is then stopped as it comes into contact with the guide devices 21 located on the guide arm 16. At this point, a photocell 27, which is a reflecting photocell, actuates the air cylinder 22 by means of a time-delay relay so that the adjacent guide arm 17 is subsequently lowered to its active position. The purpose of the time-delay relay is to ensure that the entire row of articles 1 has been moved adjacent to the guide arm 16 and into proper engagement with the guide devices 21 prior to activation of the adjacent guide arm 17.

After the guide arm 17 has been lowered, each of the guide devices 21 located on the forwardmost side thereof will then be located behind an article 1 and, thus, the guide devices 21 on the guide arm 16 and on the forwardmost side of the guide arm 17 will operate to form individual compartments each containing an article 1.

As the first row of articles 1 is brought into a location within a compartment between the two guide arms 16 and 17, there will at the same time be formed a stop arrangement for the next incoming row of articles 1 by the guide devices 21 located on the rearmost side of the guide arm 17. It should be noted that at this time, the guide arm 18 is not as yet lowered and, thus, the guide devices 21 on the rear side of the guide arm 17 will be in a position to receive the next incoming row of articles 1. A photocell 27 arranged in front of the arm senses the presence of this subsequent row of articles 1 and actuates the air cylinder 24 so that the next guide arm 18 is activated and brought into the lowered or active position. This procedure involving actuation of the air cylinders by means of photocells continues until the grouping unit has been filled with articles 1.

When the last guide arm 20 has been lowered to its active position, the grouping unit II will be in the condition depicted in FIGS. 3 and 4. That is, four separate rows of articles 1 will be contained within four separate rows of compartments formed between adjacent devices 21. It will be noted that, as shown in FIG. 3, the trays 10 located beneath the plane of the conveyor belt 2 contain receptacles or openings which are equivalent and which correspond in location to the location of the articles 1 located in the grouping unit II. Thus, it will be apparent from FIG. 3 that if the grouping unit II is shifted laterally to the right, the articles 1 may be brought to overlie the individual compartments in the packaging trays 10 located beneath the conveyor belt 2.

Thus, after the last guide arm 20 has been lowered, the air cylinder 12 is actuated and this causes horizontal movement of the trolley 11 from its leftward position to its rightward position thereby moving the grouping unit II from over the belt conveyor 2 to a position overlying the packaging trays 10. During this movement, the openings in the packaging trays 10 are covered with a planar covering sheet or member 28 which is arranged in a plane lying at a level coextensive with the upper belt part of the conveyor 2 so that the articles 1 moved by the trolley 11 may slide over the planar covering sheet 28 while still being held within the compartments defined by the guide devices 21. This movement of the trolley 11 is stopped when all of the articles 1 are located above an individual opening or compartment in the packaging trays 10.

At this point, the covering sheet 28 which is connected with a horizontally aligned air cylinder 29 is pulled away by actuation of the air cylinder 29 so that the packaging trays 10 will be exposed. The air cylinder 29 is actuated to laterally move the covering sheet 28 to uncover the packaging trays 10 when the grouping unit II with the grouped articles 1 has been located in a position above the packaging tray 10. Thus, lateral movement of the covering sheet 28 will cause each of the articles 1 to fall down into a predetermined compartment assigned thereto in the packaging trays 10.

The trolley 11 is then returned to the grouping position toward the left and the cycle is completed.

Handling of products in accordance with the invention may thus be seen to include the following steps: alignment; collection; grouping; locking; transportion; insertion.

The embodiment of the invention described herein may particularly be adapted for use in handling coconut balls or similar spherical products. Shapes other than spherical can, of course, also be handled in accordance with the principles of the invention, the basic difference being that the design of the alignment unit and of the corresponding grouping unit may require some modification or change.

Consequently, it will be seen that the present invention provides a process and apparatus for automatically aligning and inserting in packages 10 products or articles 1 which are introduced from a conveyor belt 2, the articles 1 being aligned in rows both longitudinally and laterally by an aligner unit I. The articles 1 are then moved to the grouping unit II where they are grouped to form packaging modules adapted to the packages 10. The grouped articles 1 are transferred from the conveyor belt 2 to the packages 10 by the grouping unit II.

The grouping unit II comprises means for forming individual compartments for each of the articles 1, with each of the compartments being formed by a forwardmost side and a rearmost side embodied in the devices 21. In the operation of the grouping unit II, the forwardmost sides of each of the compartments of a row is first lowered and after articles have been brought into position to be located within their preassigned compartments, the rear sides of the compartments are lowered with lowering of the rear sides of each of the compartments operating to simultaneously lower the forwardmost sides of each of the compartments of a next adjacent row.

In the operation of the aligning unit I, there is provided a detector 7, 9 in front of each of the aligning arms 3–6, and this detector 7, 9 is arranged to sense the presence of a row of products or articles 1, and upon sensing such presence, to actuate the air cylinder 8 so that the associated aligning arms 3–6 may be activated whereupon a time-delay relay associated with the detector 7, 9 is arranged so that it retains the aligning arms 3–6 in the active position until the entire row of articles 1 has been aligned.

After the row has been aligned, the articles are then fed to the grouping unit II wherein compartments arranged to correspond with the aligned rows of articles are operable to have the articles engaged within the compartments so that the articles may be moved as a unit while being maintained in their prescribed relative positions to be dropped into the packaging trays 10. It will be noted that the grouping unit II operates to move the articles 1 laterally to a position over the packaging trays 10 while simultaneously maintaining the articles 1 grouped in a pattern which coincides with the pattern of the compartments within the packaging trays 10 into which the articles are to be deposited.

While a specific embodiment of the invention has been shown and described in detail to illustrate the application of the inventive principles, it will be understood that the invention may be embodied otherwise without departing from such principles.

What is claimed is:

1. Packaging apparatus for automatically aligning and inserting discrete articles comprising: conveyor means for conveying said articles in a given direction of travel; aligner means comprising a plurality of aligning arms arranged to extend laterally across said direction of travel, said aligning arms being arranged consecutively so as to be operable for aligning said articles in successive rows; a grouping unit comprising a plurality of guide arms which are arranged to extend laterally across said direction of travel and which are located consecutively relative to each other so as to be useful for grouping said articles to form packaging modules, said grouping unit being arranged so that it operates to transfer said articles by operation of said guide arms from said conveyor means into packages adapted to receive said articles, and air cylinders operable to move said aligning arms between an inactive position above said conveyor belt and an active position above said conveyor belt, said inactive position being higher and more distant from said conveyor belt than said active position, said aligning arms when in said active position operating to halt the movement of articles which have been fed thereto on said conveyor means and to move said articles longitudinally and laterally against said direction of travel.

2. Apparatus according to claim 1 further comprising detector means provided adjacent each of said aligning arms and operable to sense the presence of a row of articles, said detector means being operable upon sensing of the presence of said row of articles to actuate said air cylinders so that an associated aligning arm may be activated to be brought into its active position, and time-delay relay means associated with said detector means arranged to retain said aligning arms in said active position until an entire row of articles has been aligned thereby.

3. Apparatus according to claim 1 wherein said aligning arms are arranged to successively align said articles which have been fed forwardly on said conveyor means.

4. Packaging apparatus for automatically aligning and inserting discrete articles comprising: conveyor means for conveying said articles in a given direction of travel; aligner means comprising a plurality of aligning arms arranged to extend laterally across said direction of travel, said aligning arms being arranged consecutively so as to be operable for aligning said articles in successive rows; a grouping unit comprising a plurality of guide arms which are arranged to extend laterally across said direction of travel and which are located consecutively relative to each other so as to be useful for grouping said articles to form packaging modules, said grouping unit being arranged so that it operates to transfer said articles by operation of said guide arms from said conveyor means into packages adapted to receive said articles, and trolley means located to extend above said conveyor means and said packages and having said guide arms of said grouping unit mounted thereon, first air cylinder means for moving said guide arms between a lower active position and a higher inactive position, second air cylinder means for moving said trolley between a first position where said grouping unit is located above said conveyor means to a second position where said grouping unit is located above said packages, and detector means arranged on said trolley adjacent to each of said guide arms to sense the presence of a row of articles beside an associated guide arm, said detector means operating to move said guide arms from said inactive positions to said active positions by actuation of said first air cylinder means when said detectors sense the presence of a row of articles beside said guide arms.

5. Apparatus according to claim 4 wherein each of said guide arms is provided with guide devices arranged so that said guide devices on one guide arm taken together with guide devices on an adjacent guide arm form separate compartments for each individual article to group said articles in a row of articles, said guide arms including outermost guide arms on opposite sides of said grouping unit having guide devices on one side thereof facing inwardly with intermediate guide arms located between said outer guide arms having guide devices on both sides thereof.

6. Packaging apparatus for automatically aligning and inserting discrete articles comprising: conveyor means for conveying said articles in a given direction of travel; aligner means comprising a plurality of aligning arms arranged to extend laterally across said direction of travel, said aligning arms being arranged consecutively so as to be operable for aligning said articles in successive rows; a grouping unit comprising a plurality of guide arms which are arranged to extend laterally across said direction of travel and which are located consecutively relative to each other so as to be useful for grouping said articles to form packaging modules, said grouping unit being arranged so that it operates to transfer said articles by operation of said guide arms from said conveyor means into packages adapted to receive said articles, and said packages into which said articles are to be inserted being arranged adjacent said conveyor belt means downstream thereof, said packages being formed with upwardly facing open receptacles adapted to receive therein said articles, said apparatus further comprising horizontally movable planar sheet means for covering said receptacles, said sheet means having a top surface which lies in a plane level with the upper part of said conveyor means, said sheet means being laterally movable to uncover said receptacles.

7. Apparatus according to claim 6 wherein said grouping unit is arranged so that it will move grouped products from said conveyor means to a position above said packages, said sheet means being arranged so that it is moved from above said packages to uncover said receptacles therein when said grouping unit has been moved to a position above said packages so that articles contained in said grouping unit may drop into said receptacles in said packages from said grouping unit.

8. Packaging apparatus for automatically aligning and inserting discrete articles into packages comprising:

conveying means for conveying said articles in a given direction of travel;

aligner means comprising a plurality of aligning arms extending laterally across said conveying means transversely to said given direction of travel, said aligner means operating to selectively engage articles on said conveying means for aligning said articles in rows extending laterally across said conveying means;

grouping means arranged to engage said aligned rows of articles for transferring said articles aligned in said rows into package means from said conveyor means;

package means located below said grouping means to receive therefrom said aligned rows of articles;

said grouping means comprising means for horizontally sliding said articles from a first position overlying said conveyor means to a second position overlying said package means;

said apparatus further comprising planar cover means arranged to extend in a horizontal plane generally coextensive with said conveyor means and operative to be shifted laterally from a first position overlying said package means to a second position uncovering said package means;

said planar cover means being maintained in said first position until said grouping means have been moved to slide said articles to said second position overlying said package means; and said planar cover means being subsequently shifted to said second position to uncover said package means and to allow said articles to drop into said package means from said grouping means.

9. Apparatus according to claim 8 wherein said grouping means comprise compartment means defining individual compartments each adapted to receive therein one of said articles, said grouping means operating to transfer said articles while in said compartments from a position overlying said conveying means to a position overlying said package means.

10. Apparatus according to claim 9 wherein said compartments are arranged in adjacent rows extending transversely across said given direction of travel.

11. Apparatus according to claim 10 wherein said compartment means comprise forwardmost compartment means defining the forwardmost sides of each of said compartments in a given row and rearmost compartment means defining the rearmost sides of each of said compartments in a given row, said forwardmost compartment means and said rearmost compartment means being movable vertically relative to said conveyor means to enable said articles to be inserted into said compartments between said forwardmost compartment means and said rearmost compartment means wherein said forwardmost and said rearmost compartment means in adjacent rows are commonly supported and vertically movable in unison relative to said conveyor means.

12. Apparatus according to claim 11 further comprising means for moving each of the forwardmost compartment means in a given row downwardly before downward movement of said rearmost compartment means, with movement of said rearmost compartment means being effected after articles to be received in said compartments have been brought into position relative to said forwardmost compartment means.

13. Packaging apparatus for automatically aligning and inserting discrete articles into packages comprising:

conveying means for conveying said articles in a given direction of travel;

aligner means comprising a plurality of aligning arms extending laterally across said conveying means transversely to said given direction of travel, said aligner means operating to selectively engage articles on said conveying means for aligning said articles in rows extending laterally across said conveying means;

grouping means arranged to engage said aligned rows of articles for transferring said articles aligned in said rows into package means from said conveyor means;

package means located below said grouping means to receive therefrom said aligned rows of articles; and wherein said grouping means comprise compartment means defining individual compartments each adapted to receive therein one of said articles, said grouping means operating to transfer said articles while in said compartments from a position overlying said conveying means to a position overlying said package means; and wherein said compartments are arranged in adjacent rows extending transversely across said given direction of travel; wherein said compartment means comprise forwardmost compartment means defining the forwardmost sides of each of said compartments in a given row and rearmost compartment means defining the rearmost sides of each of said compartments in a given row, said forwardmost compartment means and said rearmost compartment means being movable vertically relative to said conveyor means to enable said articles to be inserted into said compartments between said forwardmost compartment means and said rearmost compartment means wherein said forwardmost and said rearmost compartment means in adjacent rows are commonly supported and vertically movable in unison relative to said conveyor means; and wherein said apparatus further comprises means for moving each of the forwardmost compartment means in a given row downwardly before downward movement of said rearmost compartment means, with movement of said rearmost compartment means being effected after articles to be received in said compartments have been brought into position relative to said forwardmost compartment means.

* * * * *